US007917992B2

(12) United States Patent
McIntyre

(10) Patent No.: US 7,917,992 B2
(45) Date of Patent: Apr. 5, 2011

(54) GUTTER CLEANING VACUUM SYSTEM INCLUDING A NOVEL HINGED VACUUM MANIFOLD ASSEMBLY

(76) Inventor: Paul Curtis McIntyre, Charlotte, NC (US)

( * ) Notice: Subject to any disclaimer, the term of this patent is extended or adjusted under 35 U.S.C. 154(b) by 1012 days.

(21) Appl. No.: 11/726,465

(22) Filed: Mar. 21, 2007

(65) Prior Publication Data

US 2007/0226945 A1 Oct. 4, 2007

Related U.S. Application Data

(60) Provisional application No. 60/784,247, filed on Mar. 21, 2006.

(51) Int. Cl.
*A47L 7/00* (2006.01)

(52) U.S. Cl. ..... 15/327.1; 15/347; 15/246.2; 15/415.1; 55/DIG. 3

(58) Field of Classification Search ..... 15/327.1, 15/347, 415.1, 246.2; 55/DIG. 3; *A47L 7/00, A47L 9/00*

See application file for complete search history.

(56) References Cited

U.S. PATENT DOCUMENTS

| | | | |
|---|---|---|---|
| 3,570,222 | A | 3/1971 | Dudek et al. |
| 4,072,483 | A | 2/1978 | Doyle, Jr. |
| 4,467,494 | A | 8/1984 | Jones |
| 4,654,926 | A | 4/1987 | McCambridge |
| 4,723,971 | A | 2/1988 | Caldas |
| 5,069,696 | A | 12/1991 | Bruno, III |
| 5,242,588 | A | 9/1993 | Reese |
| 5,259,087 | A | 11/1993 | Loveless et al. |
| 5,535,475 | A | 7/1996 | Sauter |
| 6,170,118 | B1 | 1/2001 | McIntyre et al. |
| 6,519,809 | B2 | 2/2003 | Gutry |

*Primary Examiner* — David A Redding

(74) *Attorney, Agent, or Firm* — Clements Bernard PLLC; Christopher L. Bernard; Lawrence A. Baratta, Jr.

(57) ABSTRACT

In various exemplary embodiments, the present invention provides a lightweight, maneuverable, thin-walled, transparent apparatus for use with a heavy-duty vacuum system for quickly and easily collecting and storing large volumes of bulky debris, thereby reducing the time needed for cleanup. The present invention also provides an improved vacuum manifold assembly that may be used in conjunction with various gas and electric blower/vacuum motors, both novel and conventional. The present invention further provides various gutter cleaning and other tools that may be used in conjunction with such a vacuum system. The gutter cleaning vacuum system including the improved hinged vacuum manifold assembly of the present invention has sufficient power and is designed such that the various gutter cleaning and other tools are effective, suction-wise, at great distances from the unit, such that an operator may use the gutter cleaning and other tools at great distances over his/her head, for example.

22 Claims, 19 Drawing Sheets

GUTTER CLEANING VACUUM SYSTEM INCLUDING A NOVEL HINGED VACUUM MANIFOLD ASSEMBLY

CROSS-REFERENCE TO RELATED APPLICATION(S)

The present non-provisional patent application claims the benefit of priority of U.S. Provisional Patent Application No. 60/784,247, filed on 21 Mar. 2006, and entitled "GUTTER CLEANING VACUUM SYSTEM INCLUDING A NOVEL HINGED VACUUM MANIFOLD ASSEMBLY," the contents of which are incorporated in full by reference herein.

FIELD OF THE INVENTION

The present invention relates generally to the vacuum system and gutter cleaning fields, among others. More specifically, the present invention relates to a gutter cleaning vacuum system including a novel hinged vacuum manifold assembly. This gutter cleaning vacuum system including a novel hinged vacuum manifold assembly may be used in conjunction with various gas and electric blower/vacuum motors, both novel and conventional, and with various gutter cleaning and other tools, both novel and conventional. Advantageously, the gutter cleaning vacuum system including a novel hinged vacuum manifold assembly has sufficient power and is designed such that the various gutter cleaning and other tools are effective, suction-wise, at great distances from the unit, such that an operator may use the gutter cleaning and other tools at great distances over his/her head, for example.

BACKGROUND OF THE INVENTION

Various vacuum systems have been used for many years for the purposes of collecting material and cleaning particulate debris in industrial, commercial, and residential applications. Heavy-duty vacuum systems with large collection capacities are essential to collecting material and cleaning particulate debris in factories, lumber yards, construction sites, amusement parks, conventional halls, shopping centers, residences, and the like. Likewise, heavy-duty vacuum systems with large collection capacities are essential to collecting material and cleaning particulate debris in gutter cleaning applications. This is due not only to the fact that such applications often contain a great volume of discarded or unwanted material, but also because of the fact that such discarded or unwanted material tends to be found in a wide variety of shapes, sizes, and constituent materials (including wet constituent materials). In addition, various industrial, commercial, and other applications often contain a great volume of material which may be desirable to reuse or recycle.

Typical industrial/commercial vacuum systems which include an upright metal canister connected to a blower/vacuum motor, some of which may be suitable for gutter cleaning applications, for example, are disclosed in U.S. Pat. Nos. 4,723,971 and 4,467,494. One disadvantage of this type of industrial/commercial vacuum system is its large, bulky design. Vacuum systems of such designs are comparatively heavy due to the metal cylinder which forms the receptacle for debris. Due to their bulk and weight, such vacuum systems may be difficult to maneuver over large areas, such as factory floors, lumber yards, construction sites, amusement parks, convention halls, shopping centers, residences, and the like. Likewise, such vacuum systems may be difficult to maneuver outdoors in gutter cleaning applications. Further, such vacuum systems that use suction (water-lift) to clean, typically have only 60-80 CFM (approximately 1700-2265 liters/minute) of air flow, and typically use a maximum two-inch (approximately 5-centimeter) diameter intake hose that limits the size of the material collected. Thus, there is a loss of power when the vacuum intake is extended beyond a few feet (meters) from the unit.

Another disadvantage of such vacuum systems is that the metal cylinder which forms the receptacle for debris is not designed to accommodate large volumes of bulky material. Additional examples of vacuum systems with similar metal cylinders which form the receptacles for debris are disclosed in U.S. Pat. Nos. 3,570,222; 4,072,483; 5,069,696; 5,242,588; and 5,259,087, among others.

U.S. Pat. No. 6,170,118, issued to McIntyre et al. on Jan. 9, 2001, and commonly assigned to Upkeeper Corporation, is incorporated in full by reference herein. Another portable and mobile industrial/commercial vacuum system ideal for the collection of bulky debris, such as plastic pellets, packing peanuts, fabric, paper, carpet clippings, empty aluminum cans, drinking cups and straws, popcorn, etc. is the UPKEEPER VOYAGER TURBO TRANSFORMER®, as disclosed in U.S. Pat. No. 5,722,110, manufactured by and commonly assigned to Upkeeper Corporation, also incorporated in full by reference herein. Unlike conventional vacuum systems that use suction (water-lift) to clean, the turbo fan technology used in the Upkeeper vacuum system generates 500 CFM (approximately 14157 liters/minute) of air flow to clean debris with ease, and the air flow works even at distances of 20-25 feet (approximately 6-7.5 meters) overhead. This and other technological advances of Upkeeper Corporation may be applied to gutter cleaning applications and the like, as disclosed herein.

While the Upkeeper vacuum system has greatly advanced the art related to industrial/commercial vacuum systems, it is designed to include a receptacle for debris or collection bag which may not be suitable for storing large volumes of material (or wet volumes of material, in the gutter cleaning case). When the collection bag is full, the operator must turn off the vacuum system power and empty the collection bag before continuing to collect debris. Thus, the cleanup process is slowed. While there are conventional vacuum systems that are designed to provide large receptacles for debris, and even wet debris, these conventional vacuum systems are heavy and awkward, and require a large space for storage of the machine, not to mention large packaging for shipping of the machine.

In addition, conventional vacuum systems providing 60-80 CFM (approximately 1700-2265 liters/minute) of air flow must have a receptacle for debris that is constructed of a sturdy material, such as metal, which requires a large space for storage and large packaging for shipping. Without such a sturdy material, the receptacle for debris would likely implode (collapse) under suction. Thus, conventional materials for such vacuum systems have not been lightweight. In general, these conventional vacuum systems have not been designed for the collection of bulky or wet debris, such as plastic pellets, packing peanuts, fabric, paper, carpet clippings, empty aluminum cans, drinking cups and straws, popcorn, leaves, pinecones, mulch, etc.

Therefore, there is a need in the art for a lightweight, maneuverable, thin-walled, transparent apparatus for use with a heavy-duty vacuum system for quickly and easily collecting and storing large volumes of bulky debris, thereby reducing the time needed for cleanup. There is also a need in the art for an improved vacuum manifold assembly that may be used in conjunction with various gas and electric blower/vacuum motors, both novel and conventional. There is further a need in the art for various gutter cleaning and other tools that may be used in conjunction with such a vacuum system. Preferably, the desired gutter cleaning vacuum system including the improved hinged vacuum manifold assembly would have sufficient power and would be designed such that the various gutter cleaning and other tools would be effective, suction-wise, at great distances from the unit, such that an operator may use the gutter cleaning and other tools at great distances over his/her head, for example.

BRIEF SUMMARY OF THE INVENTION

In various exemplary embodiments, the present invention provides a lightweight, maneuverable, thin-walled, transparent apparatus for use with a heavy-duty vacuum system for quickly and easily collecting and storing large volumes of bulky debris, thereby reducing the time needed for cleanup. The present invention also provides an improved vacuum manifold assembly that may be used in conjunction with various gas and electric blower/vacuum motors, both novel and conventional. The present invention further provides various gutter cleaning and other tools that may be used in conjunction with such a vacuum system. The gutter cleaning vacuum system including the improved hinged vacuum manifold assembly of the present invention has sufficient power and is designed such that the various gutter cleaning and other tools are effective, suction-wise, at great distances from the unit, such that an operator may use the gutter cleaning and other tools at great distances over his/her head, for example.

In one exemplary embodiment, the present invention provides a high volume vacuum collection apparatus, including: a blower/vacuum unit operating in a suction mode, generating a partial vacuum, and suctioning high volume flowing air; a collection drum comprising a container having a base supporting the container, a top, and a removable lid with at least a first inlet and a second inlet, wherein the first inlet serves as an exit for the flowing air and the second inlet serves as an entrance for the flowing air and debris suctioned into the collection drum; a manifold assembly that is in fluid communication with the blower/vacuum unit and the collection drum, thereby distributing the partial vacuum and the flowing air, wherein the manifold assembly has a top portion, a center portion at an offset angle to the top portion, and a bottom portion at an offset angle to the center portion, wherein the top portion has a top port that fluidly and fixedly or removably engages the first inlet of the removable lid, and wherein the top portion is in fluid communication with the center portion; and wherein, in operation, as the suctioned high volume flowing air and debris are suctioned into the collection drum, the debris falls out, collected by the container of the collection drum, and the flowing air exits through the manifold assembly. At least a portion of the collection drum is sufficiently transparent such that a level of collected debris can be visually determined with the removable lid on the collection drum, and while the apparatus is being operated. The manifold assembly has fluid communication through all portions, the suction emanating at an exhaust port that is in fluid communication with an air intake side of the blower/vacuum unit. The bottom portion of the manifold assembly further comprises a bottom port that is fluidly and fixedly or removably in communication with a third inlet, wherein the third inlet is on the collection drum. Operationally, the partial vacuum and air flow in the manifold assembly are distributed throughout the manifold, and the partial vacuum on the outside of a liner disposed within the container will have a lower pressure than a pressure on the inside of the liner, thereby maintaining the liner adhered to an interior surface of the container. The second inlet has an inlet adapter with an intake for large intake capacity and smaller diameter cleaning accessories. The inlet adapter has a multi-hose distribution head, such that several and various hoses, gutter cleaning, or other tools can be simultaneously attached. The removable lid further comprises an integral air filter. The removable lid has a dome shape to accommodate a larger air filter and to accommodate multiple second inlets that each have an inlet adapter with an intake for large intake capacity and smaller diameter cleaning accessories. The integral air filter is positioned between the manifold assembly connection and an interior of the container. The integral air filter is removably attached to a bottom inner side of the removable lid with a fastening means, such as a hook-and-loop type fastener with complimentary mated fastener strips. The removable lid has foam or rubber stripping along the interior of the rim for securing the removable lid to the container, wherein the stripping provides an air seal between the removable lid and the container. The manifold assembly comprises one or more of a hinged top portion, a telescoping center portion, and a hinged bottom portion. The hinged manifold assembly can have one, two or all three portions of the manifold are telescoping, so as to expand or collapse to accommodate collection drums of various sizes. For instance a larger diameter collection drum would require a telescoping tom and bottom portion. A taller collection drum would utilize a telescoping center portion.

In another exemplary embodiment, the present invention provides a high volume vacuum collection apparatus, including: a blower/vacuum unit operating in a suction mode, generating a partial vacuum, and suctioning high volume flowing air; a collection drum comprising a container having a base supporting the container, a top, and a removable lid with a first inlet and a second inlet, wherein the first inlet serves as an exit for the flowing air and the second inlet serves as an entrance for flowing air and debris suctioned into the collection drum; a hinged manifold assembly that is in fluid communication with the blower/vacuum unit and the collection drum, thereby distributing the partial vacuum and the flowing air; wherein the manifold assembly has a top portion, a center portion, and a bottom portion, wherein the top portion has a top port that fluidly and fixedly or removably engages the first inlet of the removable lid, wherein the top portion is in hinged fluid communication with the center portion through a top hinge mechanism that allows the top portion to be rotated upward with respect to the center portion, and wherein the center portion is in hinged fluid communication with the bottom portion through a lower hinge mechanism that also allows rotation; and wherein, in operation, as the suctioned high volume flowing air and debris are suctioned into the collection drum, the debris falls out, collected by the container of the collection drum, and the flowing air exits through the hinged manifold assembly. The center portion of the hinged vacuum manifold assembly comprises a telescoping mechanism for selectively adjusting the effective length of the center portion of the hinged vacuum manifold assembly, which accommodates a variety of collection drums. The base supports the bottom of the container. The base is sufficiently reinforcing such that that the apparatus is fully portable, either hand carried, or carted by hand, or carried by a self-powered cart. The apparatus is carried on a vehicle, trailer, or the like, such as a gas or electric utility light-weight cart/ATV which is operationally suitable for movement over the ground. The hinged vacuum manifold assembly has a swivel connection, permitting hose connections to the second inlet to be used approximately 340 degrees around the axis of the swivel connection. The swivel connection employs a push through gasket. The hinged manifold assembly comprises two rectangular ducts each having an interior cross-sectional area comparable to the three manifold assembly portions, where the two rectangular ducts are hingedly coupled through a modified pipe joint, thereby permitting the movement of air and the hinged rotation of the ducts. The suctioned high volume air provided by the blower/vacuum unit is greater than 60 CFM (approximately 1700 liters/minute), and typically greater than 200 CFM (approximately 5663 liters/minute).

In a further exemplary embodiment, the present invention provides a high volume vacuum collection apparatus, including: a blower/vacuum unit operating in a suction mode, generating a partial vacuum, and suctioning high volume flowing air; a collection drum comprising a container having a base supporting the container, a top, a liner, and a removable lid with a first inlet and a second inlet, wherein the first inlet serves as an exit for the flowing air and the second inlet serves as an entrance for the flowing air and debris suctioned into the collection drum; a hinged manifold assembly that is in fluid communication with the blower/vacuum unit and the collection drum, thereby distributing the partial vacuum and the flowing air; wherein the manifold assembly has a top portion, a center portion, and a bottom portion, wherein the top portion has a top port that fluidly and fixedly or removably engages the first inlet of the removable lid, and wherein the bottom portion is in hinged fluid communication with the center portion through a hinge mechanism; wherein, in operation, as the suctioned high volume flowing air and debris is suctioned into the collection drum, the debris falls out, collected by the liner in the collection drum, and the flowing air exits through the hinged manifold assembly; and wherein the collection drum is emptied by tilting back the top portion and center portion of the hinged manifold assembly and the removable lid, removing the debris filled liner, inserting an empty liner, and closing the hinged manifold assembly and the removable lid.

BRIEF DESCRIPTION OF THE DRAWINGS

The present invention is illustrated and described herein with reference to the various drawings, in which like reference numbers denote like system components and/or parts, as appropriate, and in which.

DETAILED DESCRIPTION OF THE INVENTION

In various exemplary embodiments, the present invention provides a lightweight, maneuverable, thin-walled, transparent apparatus for use with a heavy-duty vacuum system for quickly and easily collecting and storing large volumes of bulky debris, thereby reducing the time needed for cleanup. The present invention also provides an improved vacuum manifold assembly that may be used in conjunction with various gas and electric blower/vacuum motors, both novel and conventional. The present invention further provides various gutter cleaning and other tools that may be used in conjunction with such a vacuum system. The gutter cleaning vacuum system including the improved hinged vacuum manifold assembly of the present invention has sufficient power and is designed such that the various gutter cleaning and other tools are effective, suction-wise, at great distances from the unit, such that an operator may use the gutter cleaning and other tools at great distances over his/her head, for example.

Figure 1:
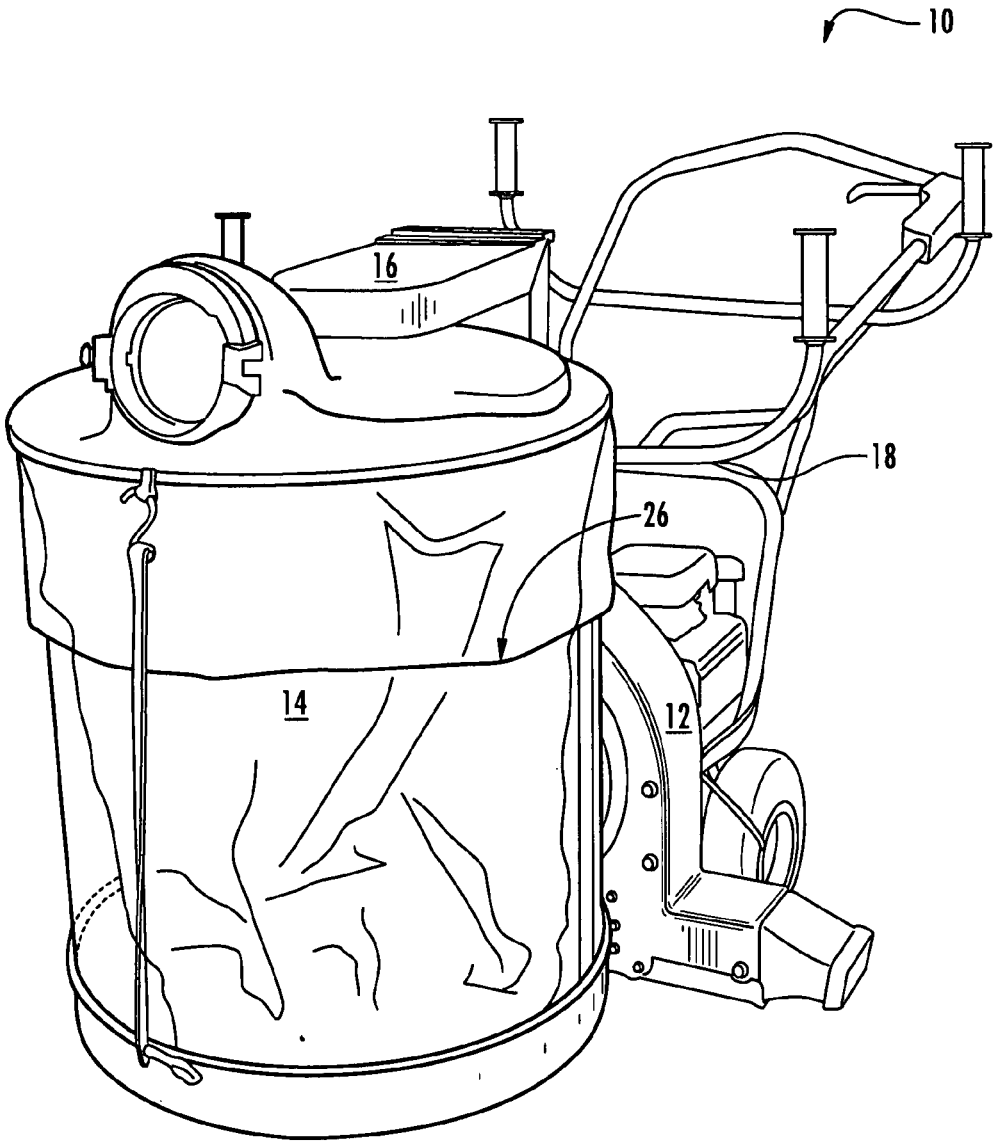
FIG. 1 is a perspective view illustrating one exemplary embodiment of the gutter cleaning vacuum system of the present invention.

Referring to FIG. 1, the gutter cleaning vacuum system 10 of the present invention includes, generally, a gas or electric blower/vacuum unit 12, a collection drum 14, a hinged vacuum manifold assembly 16, and a support structure 18. Each of these components is described in detail herein below. It should be noted that the collection drum 14 and one exemplary embodiment of the support structure are also described in U.S. Pat. No. 6,170,118, issued to McIntyre et al. on Jan. 9, 2001, and commonly assigned to Upkeeper Corporation, which is incorporated in full by reference herein.

The blower/vacuum unit 12 may include any novel or conventional electrical-powered motor or fuel-driven engine that provides sufficient blowing/sucking power for a desired application. Exemplary blower/vacuum units 12 include, but are not limited to, Billy Goat© blowers (all models), Little Wonder© blowers (all models), DR® blowers (all models), Mackissic© blowers (all models), Giant Vac© blowers (all models), Parker/Minuteman© blowers (all models), Toro© blowers (all models), Weed Eater/Pulon© blowers (all models), Husqvarna© blowers (all models), Stihl© blowers (all models), Echo© blowers (all models), Kawasaki© blowers (all models), Homelite© blowers (all models), Black & Decker© blowers (all models), ExMark© blowers (all models), Delta© blowers (all dust collector blowers), Upkeeper Voyager Blower/Vacs©, the exemplary power ranges of these units being: minimum 350 CFM (approximately 9910 liters/min) at 20 inches (approximately 51 cm) of water lift—maximum 5000 CFM (approximately 141570 liters/minute) at 60 inches (approximately 152 cm) of water lift. These blower/vacuum units 12 may be pull-start or switch-start units, and may be selectively operated in blowing or sucking mode, depending upon the desired application. For example, the blower/vacuum unit 12 may be operated in sucking mode generating a partial vacuum with suctioned high volume flowing air to clean debris from a gutter or the like, then, later, in blowing mode to clean the gutter cleaning vacuum system 10 itself. Alternatively, the gutter cleaning vacuum system 10 may be operated in blowing mode to clean debris from a gutter or the like, and may be cleaned via the intake of water, due to its ample power. Advantageously, the other components of the gutter cleaning vacuum system 10 of the present invention may be configured to work with a great variety of blower/vacuum units 12.

Figure 2:
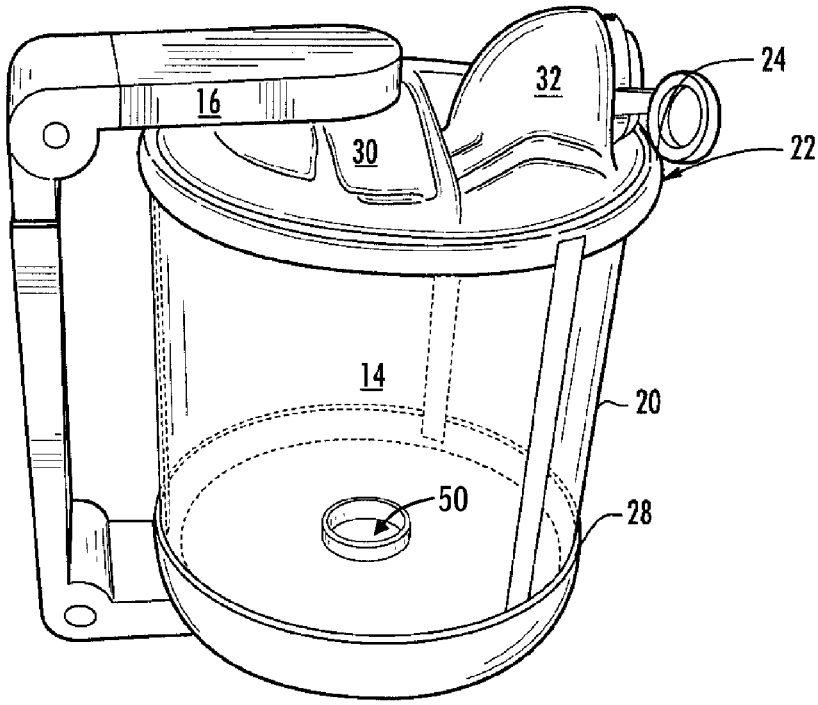
FIG. 2 is a partial perspective view illustrating one exemplary embodiment of a collection drum used in conjunction with the gutter cleaning vacuum system of FIG. 1.

Referring to FIG. 2, the collection drum 14 includes a large container 20 having an open top 22, a removable lid 24, a disposable and reusable liner 26 (FIG. 1), and a base 28 for fixedly or moveably supporting the container 20. The gutter cleaning vacuum system 10 (FIG. 1) uses a variety of intake hose attachments (described herein below), such as intake hose attachments having a large diameter and/or capacity to quickly and easily clean up large volumes of bulky debris, while simultaneously depositing the debris into the collection drum 14. Preferably, the collection drum 14 has a substantially circular cross-sectional shape in operation, a diameter of between about 18 inches (approximately 46 cm) and about 25 inches (approximately 64 cm), and a height of between about 20 inches (approximately 51 cm) and about 48 inches (approximately 122 cm), although other suitable cross-sectional shapes and dimensions may be used.

Figure 3:
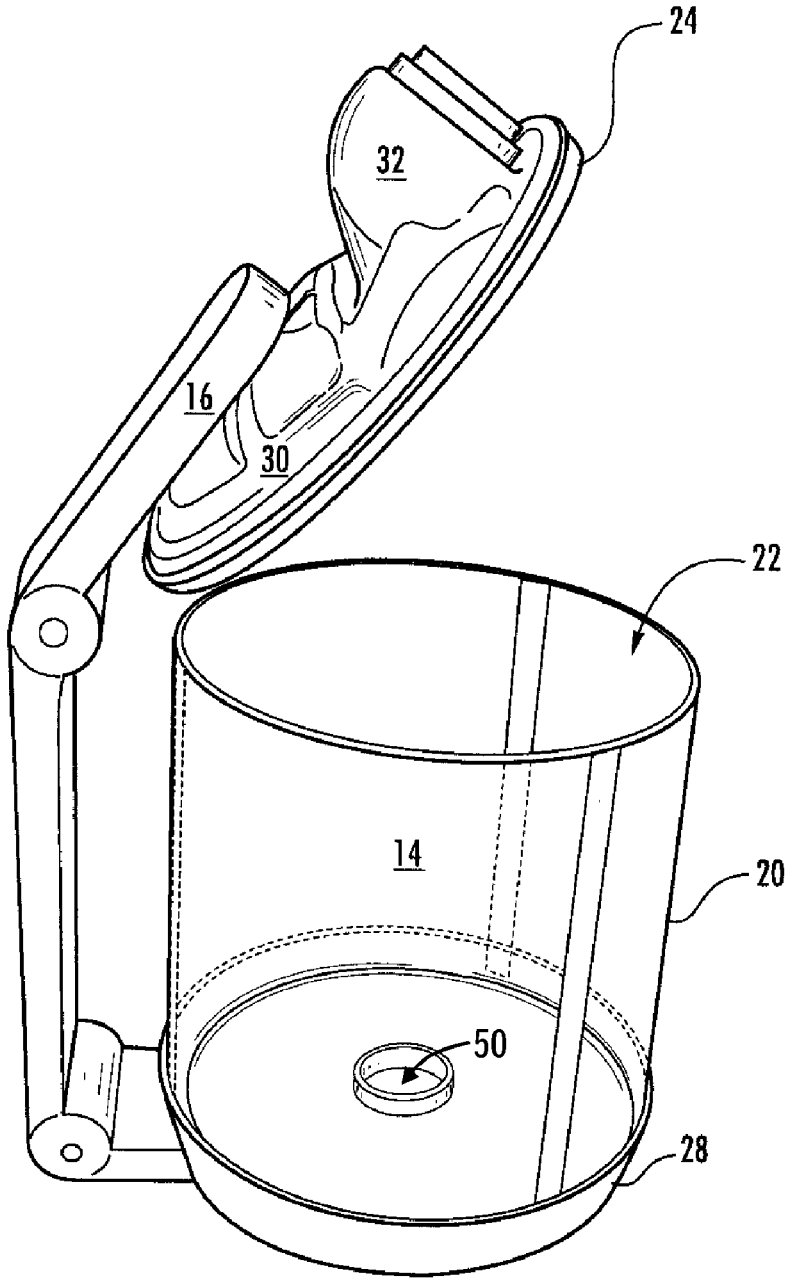
FIG. 3 is a partial perspective view illustrating the collection drum of FIG. 2 in an open configuration.
Figure 4:
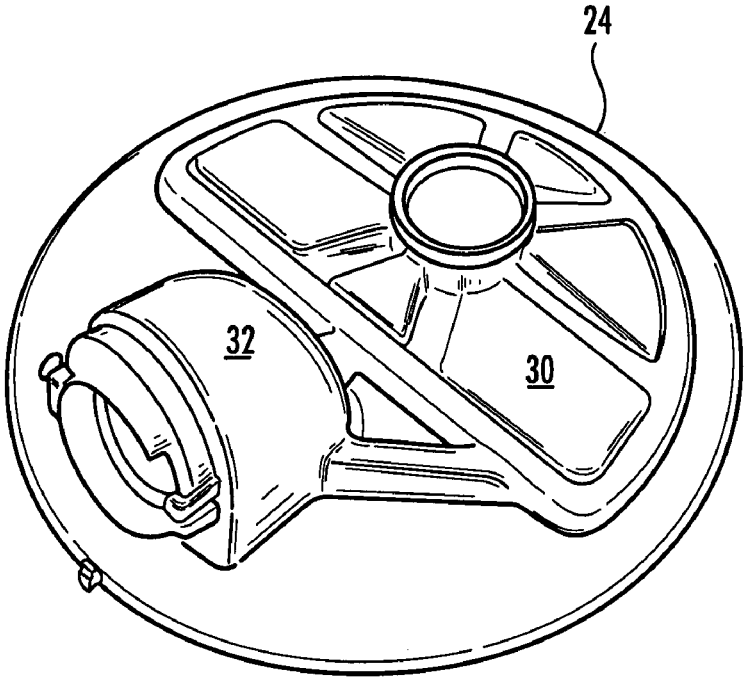
FIG. 4 is a partial perspective view illustrating one exemplary embodiment of a removable lid used in conjunction with the collection drum of FIG. 2.

Referring to FIGS. 2 and 4, in one exemplary embodiment, the removable lid 24 includes a top outer side having a raised portion and a bottom inner side having a depression formed by the raised portion. The removable lid 24 includes a rim extending downward from the top outer side around the perimeter of the removable lid 24 for securing the lid to the container 20. In a preferred embodiment, the removable lid 24 is molded from a lightweight, transparent, durable material, such as, for example, a resilient plastic material, and is sized to fit over the open top 22 of the container 20. The top outer side of the removable lid 24 includes a first inlet 30, which, when operating at a partial vacuum, serves as an exit for the flowing air, near the center of the raised portion that is adapted to be attached to the hinged vacuum manifold assembly 16 (FIGS. 1-3). The top outer side of the removable lid 24 also includes a second inlet 32, which, when operating at a partial vacuum, serves as an entrance for the flowing air and debris suctioned into the collection drum, where the second inlet is adapted for attaching a large diameter intake hose attachment. The second inlet 32 consists of a raised inlet port that extends above the top outer side of the removable lid 24. The inclusion of the second inlet 32 on the removable lid 24 permits debris to be drawn directly into the container 20 without passing through the first inlet 30 on which the hinged vacuum manifold assembly 16 is mounted. Thus, the debris bypasses the blower/vacuum unit 12 (FIG. 1) and does not enter the impeller and is deposited directly into the container 20. In a preferred embodiment, the raised inlet port of the second inlet 32 is designed to include an inlet adapter which is universally adapted to fit different intake hose accessories having a variety of hose sizes for carrying debris into the container 20. In a preferred embodiment, universal couplings or attachment components may be included for quickly and easily securing the hinged vacuum manifold assembly 16 to the first inlet 30, and for quickly and easily securing a variety of intake hose attachments to the second inlet 32. The attachment component is adapted to be received by the inlet adapter and may be connected to one end of the intake hose attachment for securely attaching the intake hose attachment to the removable lid 24. In addition, the attachment component may be connected to the hinged vacuum manifold assembly 16 and is adapted to be attached to the hinged vacuum manifold assembly 16 for mounting the hinged vacuum manifold assembly 16 to the removable lid 24.

The inlet adapter has a 4-inch (approximately 102-millimeter) diameter intake for large intake capacity and may be adapted to fit 2½-inch (approximately 64-millimeter) diameter cleaning accessories, or the inlet adapted can have a multi-hose distribution head, so that several and various hoses, gutter cleaning, or other tools can be simultaneously attached. The gutter cleaning vacuum system 10 of the present invention may also include an assortment of hose and tool arrangements for allowing a thorough means of vacuuming large industrial areas in a three dimensional fashion, or, as described in detail herein below, for gutter cleaning applications. The assortment of hose and tool arrangements may include clear extension tubes and flexible hoses in 2½-inch (approximately 64-millimeter) and 4-inch (approximately 102-millimeter) diameters, and in different lengths, such as 5, 10 and 25 feet (approximately 1.5, 3.0, and 7.5 meters, respectively).

Preferably, the removable lid 24 includes an integral filter which serves as an air-cleansing medium to contain small airborne dust and dirt particulates from discharging freely into the atmosphere. The integral filter is located in the indented portion or depression so that it is positioned between the hinged vacuum manifold assembly connection and the interior of the container 20 for filtering air drawn through the first inlet 30 by the blower/vacuum unit 12 attached to the hinged vacuum manifold assembly. The indented portion or depression can be extended such that the removable lid has a dome shape to accommodate a larger air filter and to accommodate multiple second inlets that have an inlet adapter with an intake for large intake capacity and smaller diameter cleaning accessories.

In a preferred embodiment, the filter is removably attached to the bottom inner side of the removable lid 24 and includes a hook and loop type fastener with complementary mated fastener strips, such as with VELCRO®, for quickly and easily removing the filter and reattaching the same. The filter may be cleaned simply by detaching it from the strips, without requiring the use of tools, and shaking it vigorously, using a compressed air hose, or by rinsing it. The removable lid 24 may also include a foam or rubber stripping along the interior of the rim for securing the removable lid 24 to the container 20. The stripping provides an air seal between the removable lid 24 and the container 20, thereby increasing air intake and cleaning efficiency at the collection point of the cleaning accessories.

Figure 5:
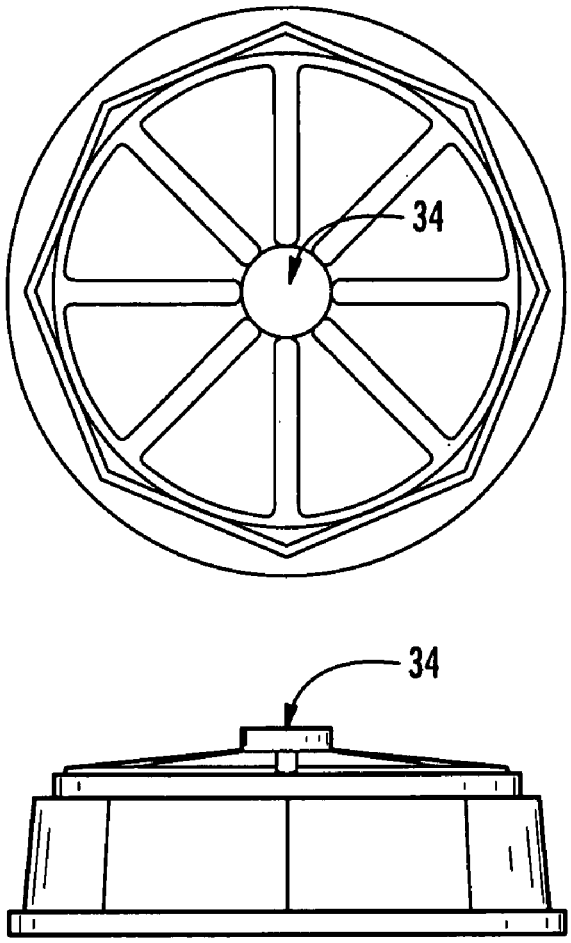
FIG. 5 is a top/side planar view illustrating another exemplary embodiment of a removable lid used in conjunction with the collection drum of FIG. 2.

Referring to FIG. 5, another embodiment of the removable lid 24 is illustrated. This removable lid 24 provides increased filter area and higher vacuum pressures, and allows for the use of more powerful blower/vacuum units 12 (FIG. 1). The removable lid 24 also allows for multiple hose connections and multiple second inlets, all hose connections powered by the same blower/vacuum unit 12, for example. A swivel connection 34 with the hinged vacuum manifold assembly connection allows hose connections to the second inlet to be used approximately 340 degrees around the axis of the swivel connection 34, effectively allowing an operator to clean in any direction around the gutter cleaning vacuum system 10 (FIG. 1), especially when the gutter cleaning vacuum system 10 is mounted on a vehicle or the like, as described in detail herein below. In a preferred embodiment, the swivel connection employs a push through gasket.

Referring again to FIG. 2, it is a feature of the present invention that a standard drum, such as, for example, a 55-gallon (approximately 208-liter) drum or other large receptacle or container having an open top, may be used, and that the removable lid 24 may be custom molded to securely fit over and cover the open top of the selected receptacle or container. In a preferred embodiment, the container 20 is a collapsible, lightweight, transparent container comprised of one or more substantially flat sheets or panels that may be readily assembled to form the container 20 having a hollow interior, open top, and open or closed bottom, and may be readily disassembled to conveniently store and ship the container 20. The container 20 of the present invention includes three preferred embodiments, each having a different means for connecting the panels to one another to form the container 20. While three preferred embodiments are described, it will be readily understood that the present invention is directed to the use of multiple panels to form a collapsible, transparent, lightweight container for use with blower/vacuum units 12 (FIG. 1) and any suitable means for connecting the panels together to form the container 20 may be used. In each preferred embodiment, the panels have opposite side ends and are made of a sturdy, lightweight, semi-flexible or resilient plastic material. The panels are transparent for permitting an operator to easily monitor the remaining capacity of the container 20 while it is in use. The clear plastic panels comprising the container 20 are approximately 0.1 inches (approximately 2.5 mm) thick and approximately 28 inches (approximately 71 cm) by 34 (approximately 86 cm) inches, so as to form a 24-inch (approximately 61-centimeter) internal diameter when joined and forming the container 20, although other suitable dimensions may be used. While two or three panels are common, it will be readily understood that one or more panels may be used as desired to form the container 20. In each preferred embodiment, the panels include top and bottom ends, each having a rim, and may include a top and bottom sponge or rubber type air seal member adapted to be fitted onto the top and bottom rims of the container 20.

In a first preferred embodiment of the container 20, the panels are assembled into the container 20 using hardware to secure the panels together to form the container 20. The panel sides include panel edges, with one panel side having a double layer of material at the panel edge to form a pocket for receiving the panel edge of the adjacent panel. The panel edges are then secured to each other utilizing washers, screws, nuts, and/or push-through fasteners that penetrate the panel edges and secure the panels together to form the container 20. In a second preferred embodiment of the container 20, the panels of the container 20 are custom molded to interlock with each other using no hardware to form the container 20. The panel edges of the second preferred embodiment each include a hook-shaped end for hooking onto the adjacent panel edge and securing the panels to form the container 20. In a third preferred embodiment of the container 20, the panels have flat edges and are assembled into the container 20 by attaching a metal or plastic connector strip between the panel edges of two adjacent panels. The connector strip includes an "H"-shaped member having opposite sides and a holder extending from each side of the member having a slot that is adapted to receive the panel edges of two adjacent panels. The panel edges are approximately ⅛ inch (approximately 3 mm) thick and fit snugly within the slots. Each holder includes a taper in the slot for securely holding the panel edges therein. In the fourth preferred embodiment of the container 20, the container 20 is constructed using a single panel having "C"-shaped ends. The "C"-shaped ends engage a connector strip having opposite ends. The connector strip fits over the "C"-shaped ends to secure the panel in the shape of a cylindrical container. While the preferred container 20 is a collapsible, multi-piece drum, it will be readily understood that most large containers may be used with the present invention, including, but not limited to, a standard 55-gallon (approximately 208-liter) drum, a cardboard or plastic container, or the like.

The container 20 includes a transparent disposable bag or liner 26 (FIG. 1) having an open top end, side walls, and a closed bottom end for receiving and storing the debris deposited into the container 20. When the liner 26 is full, the removable lid 24 is removed and the liner 26 is quickly and easily lifted from the container 20 and emptied for reusing the liner 26 or simply disposed by the operator. A preferred liner 26 includes a plurality of through or vent holes near the open top end to provide an air path through which air entering the container 20 may escape for preventing the liner 26 from collapsing. The vent holes are located in the top one third of the liner 26 while the bottom two-thirds of the liner 26 is sealed for preventing leakage or spills as the liner 26 is lifted and removed from the container 20. In a preferred embodiment, the liner 26 is an internal plastic disposable bag that is utilized under the low static pressure and high CFM conditions.

While the removable lid 24 is designed to fit snugly on the open top of the container 20, the present invention may also include a means for further securing the removable lid 24 to the container 20. In a preferred embodiment, the present invention includes at least three strap ring assemblies spaced along and secured to the rim of the removable lid 24 and at least three bungee-type cords having opposite ends with one end secured to the base or the wall of the container 20 and the other end including a hook. In use, the cords extend upward from the base or wall of the container 20 and the hook is hooked to the strap rings on the removable lid 24 for helping to secure the removable lid 24 to the container 20 and prevent accidental removal of the removable lid 24 during use.

The base 28 of the present invention supports the bottom of the container 20. In a preferred embodiment, the base 28 includes a closed bottom and an upstanding sidewall and is sized to fit and forms the bottom of the container 20. In an alternative embodiment, the base 28 may also be a rotational molded plastic component or constructed of tubular and/or sheet metal. The base is sufficiently reinforcing such that that the apparatus is fully portable, either hand carried, or carted by hand or self-powered. Alternatively, the entire apparatus can be carried on a vehicle or trailer and the like. Gas and electric utility light-weight carts/ATVs are particularly suitable, as they are operationally suitable for movement over the ground.

Figure 6:
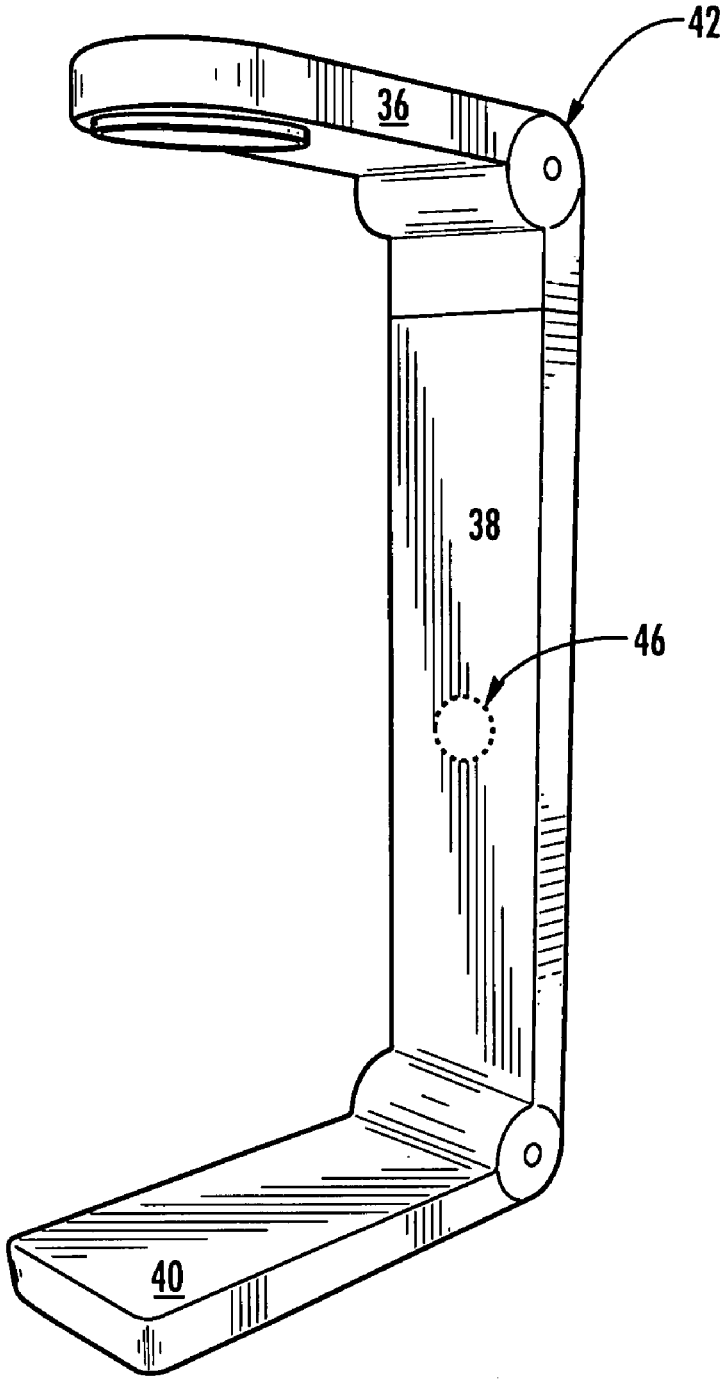
FIG. 6 is a partial perspective view illustrating one exemplary embodiment of a hinged vacuum manifold assembly used in conjunction with the gutter cleaning vacuum system of FIG. 1.

Referring to FIG. 6, the hinged vacuum manifold assembly 16 of the present invention includes a top portion 36, a center portion 38, and a bottom portion 40. The top portion 36 of the hinged vacuum manifold assembly 16 is joined with the center portion 38 of the hinged vacuum manifold assembly 16 via a hinge mechanism 42, described in greater detail herein below. The center portion 38 of the hinged vacuum manifold assembly 16 is joined with the bottom portion 40 of the hinged vacuum manifold assembly 16 via a plurality of welds, fasteners, or the like. Alternatively, the center portion 38 of the hinged vacuum manifold assembly 16 is integrally formed with the bottom portion 40 of the hinged vacuum manifold assembly 16, or the center portion 38 of the hinged vacuum manifold assembly 16 is joined with the bottom portion 40 of the hinged vacuum manifold assembly 16 via another hinge mechanism, also described in greater detail herein below. Preferably, the top portion 36 of the hinged vacuum manifold assembly 16 fluidly and fixedly or removably (through a sealing member) engages the removable lid 24 (FIGS. 2-5) of the collection drum 14 (FIGS. 1-3) through a top port 48 (see FIG. 6), thereby providing suction (or positive pressure) to the interior of the collection drum 14. Optionally, the bottom portion 40 of the hinged vacuum manifold assembly 16 fluidly and fixedly or removably (through a sealing member) engages the base 28 (FIGS. 2 and 3) of the collection drum 14 through a bottom port 50, thereby also providing suction (or positive pressure) to the interior of the collection drum 14 through a third inlet, which is preferably on the floor of the container 20. The flow provided by the bottom portion 40 aids in keeping the liner 26 (FIG. 1) adhered to the interior surface(s) of the container 20 (FIGS. 2 and 3) as the partial vacuum on the outside of the liner will have a lower pressure than the pressure on the inside of the liner, such that virtually any disposable plastic bag may be used. Accordingly, this flow provided by the bottom portion may be less than the flow provided by the top portion 36.

In a preferred embodiment, the top portion 36, center portion 38, and bottom portion 40 are hollow, and each have a substantially rectangular cross-sectional shape and an interior cross-sectional area of about 16 square inches, although other suitable shapes and dimensions may be used. The top portion 36, center portion 38, and bottom portion 40 are formed from a metal, hardened plastic, or any other suitable material. The top portion 36 has a length of between about 16 inches (approximately 40.5 cm) and about 24 inches (approximately 61 cm), the center portion 38 has a length of between about 20 inches (approximately 51 cm) and about 48 inches (approximately 122 cm), and the bottom portion 40 has a length of between about 16 inches (approximately 41 cm) and about 24 inches (approximately 61 cm), such that the hinged vacuum manifold assembly 16 may be disposed substantially about the collection drum 14 of the gutter cleaning vacuum system 10 (FIG. 1), as is illustrated in FIGS. 1 and 2.

In one exemplary embodiment, the hinge mechanism comprises two substantially rectangular ducts having interior cross-sectional area dimensions comparable to the three portions 36, 38, 40, where the two rectangular ducts are hingedly coupled through a modified pipe joint, therein permitting the movement of air and the hinged rotation of the ducts.

The center portion 38 of the hinged vacuum manifold assembly 16 further includes an exhaust port 46 (illustrated in ghost in FIG. 6) that is in fluid communication with an air intake side of the blower/vacuum unit 12 (FIG. 1), thereby forming a continuous (and sealed) air flow channel from the blower/vacuum unit 12 to the collection drum 14.

Figure 7:
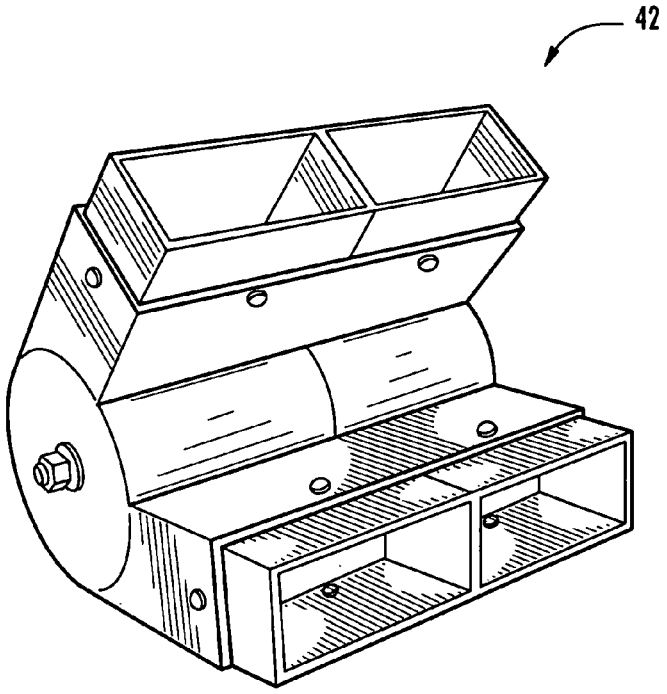
FIG. 7 is a partial perspective view illustrating one exemplary embodiment of a hinge mechanism used in conjunction with the hinged vacuum manifold assembly of FIG. 6.
Figure 8:
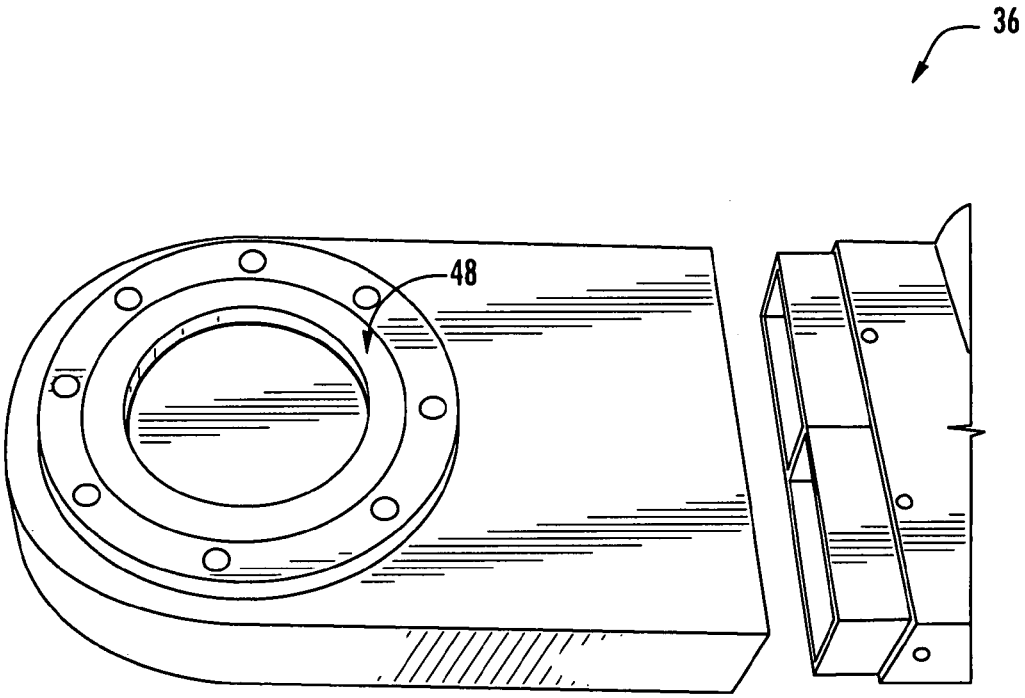
FIG. 8 is a partial perspective view illustrating one exemplary embodiment of a swiveling 320-degree inlet connection used in conjunction with the hinged vacuum manifold assembly of FIG. 6.

Referring to FIGS. 7 and 8, additional details related to the hinge mechanism 42 and top portion 36 of the hinged vacuum manifold assembly 16 are illustrated. For example, the hinge mechanism 42 may be formed from a metal, hardened plastic, or the like, or may consist of a baffle-type structure. Any suitable hinge mechanism that allows the top portion 36 of the hinged vacuum manifold assembly 16 to be rotated upward with respect to the center portion 38 of the hinged vacuum manifold assembly 16, and, thus, the removable lid 24 with respect to the container 20, may be used. This allows for quick and easy access to the interior of the container 20 for emptying, etc. FIG. 3 illustrates this hinging action.

Figure 9:
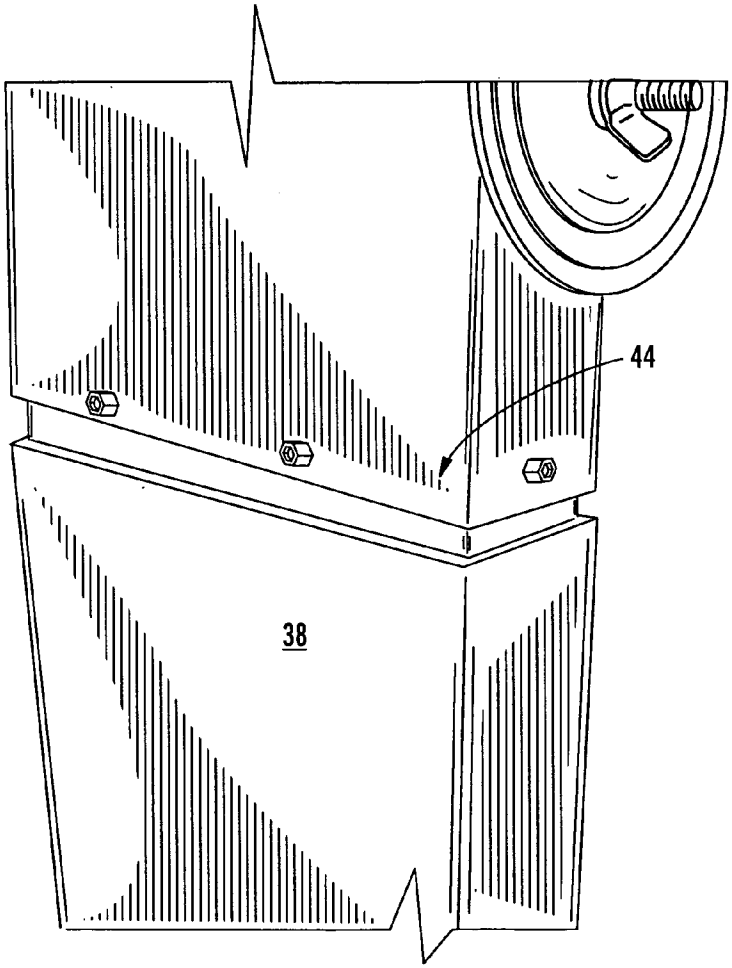
FIG. 9 is a partial perspective view illustrating one exemplary embodiment of a telescoping mechanism used in conjunction with the hinged vacuum manifold assembly of FIG. 6.
Figure 10:
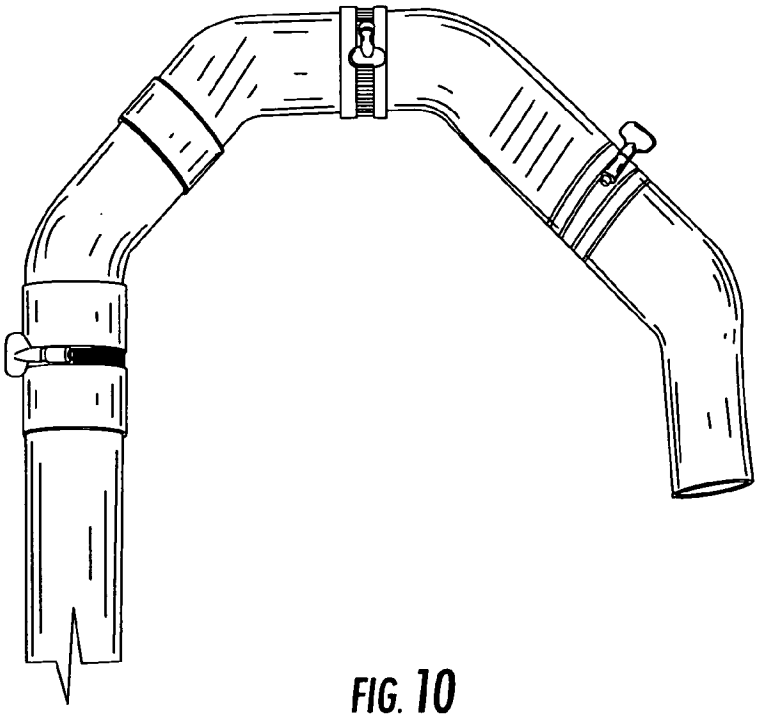
FIG. 10 is a partial perspective view illustrating one exemplary embodiment of a gutter cleaning tool used in conjunction with the gutter cleaning vacuum system of FIG. 1, with swiveling 360-degree connectors that are lockable.
Figure 11:
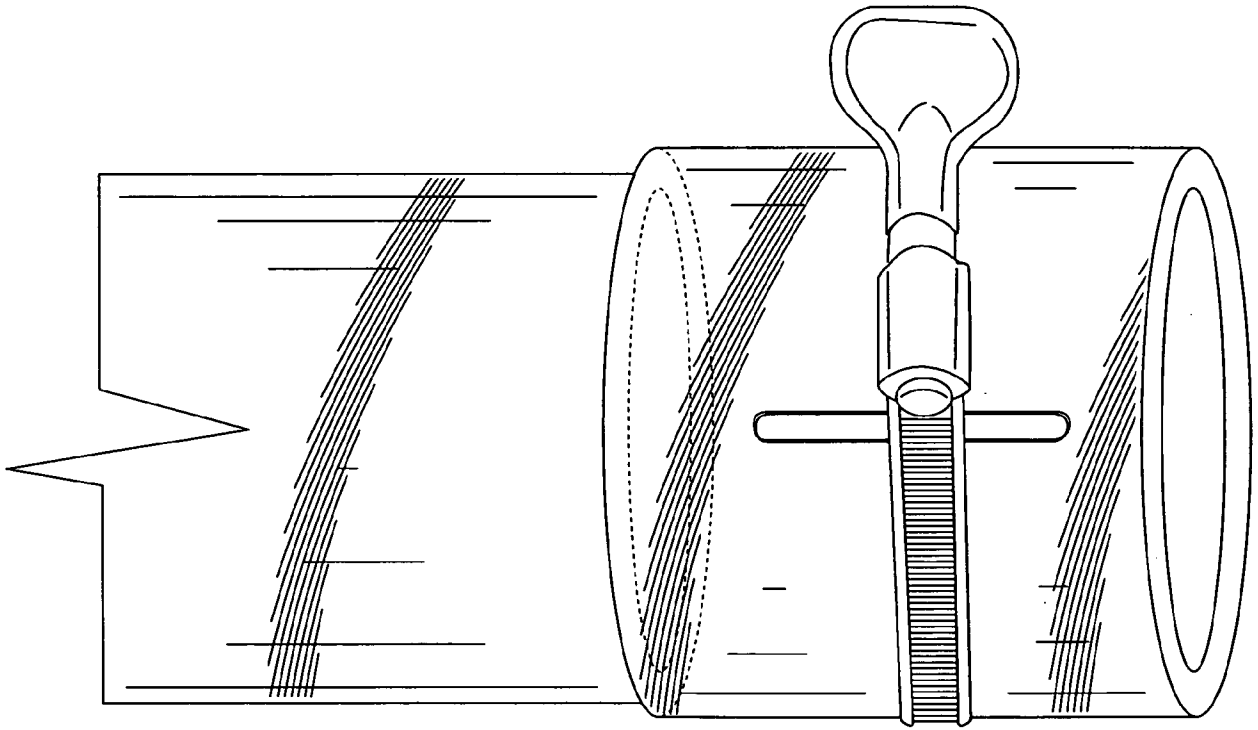
FIG. 11 is a partial perspective view illustrating one exemplary embodiment of a slotted extension coupling with a locking clamp used in conjunction with the gutter cleaning tool of FIG. 10.
Figure 12:
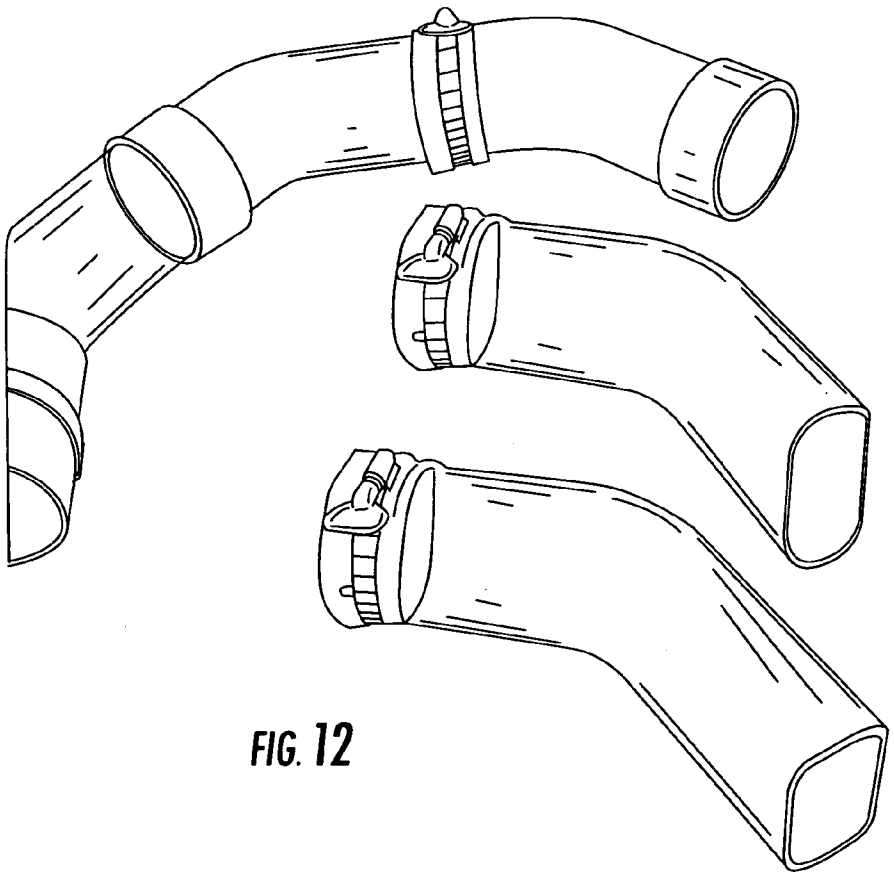
FIG. 12 is a partial perspective view illustrating various exemplary embodiments of cleaning tips used in conjunction with the gutter cleaning tool of FIG. 10.
Figure 13:
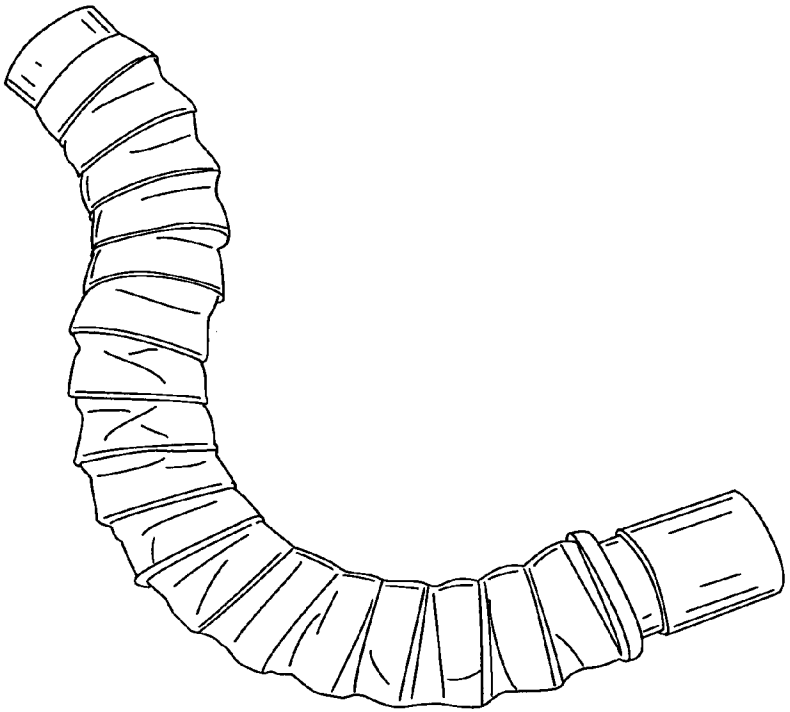
FIG. 13 is a partial perspective view illustrating one exemplary embodiment of a fully-articulated gutter cleaning tool used in conjunction with the gutter cleaning vacuum system of FIG. 1.
Figure 14:
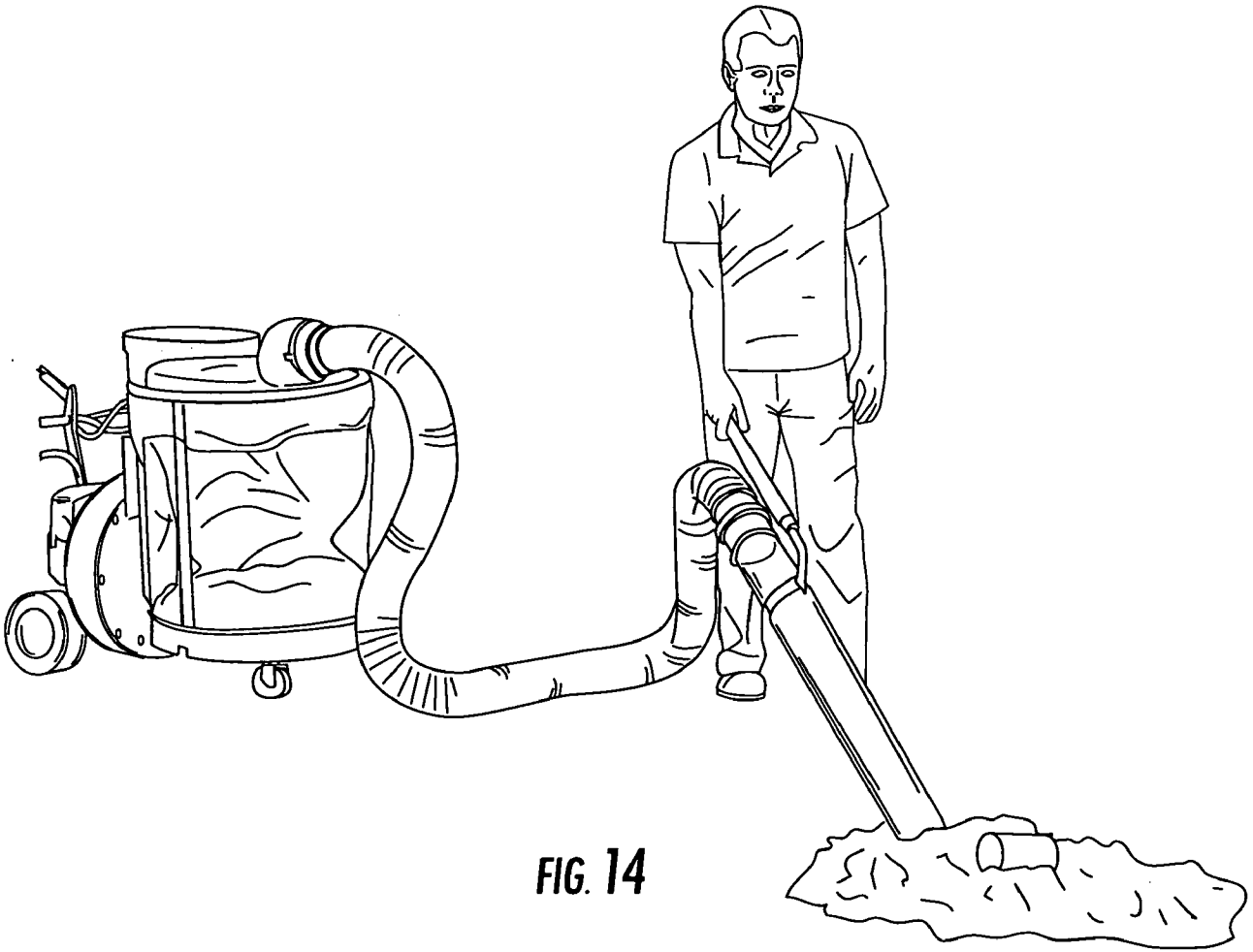
FIG. 14 is a perspective view illustrating one exemplary embodiment of a 4-inch (approximately 10-centimeter) litter cleaning hose/pipe tool used in conjunction with the gutter cleaning vacuum system of FIG. 1.
Figure 15:
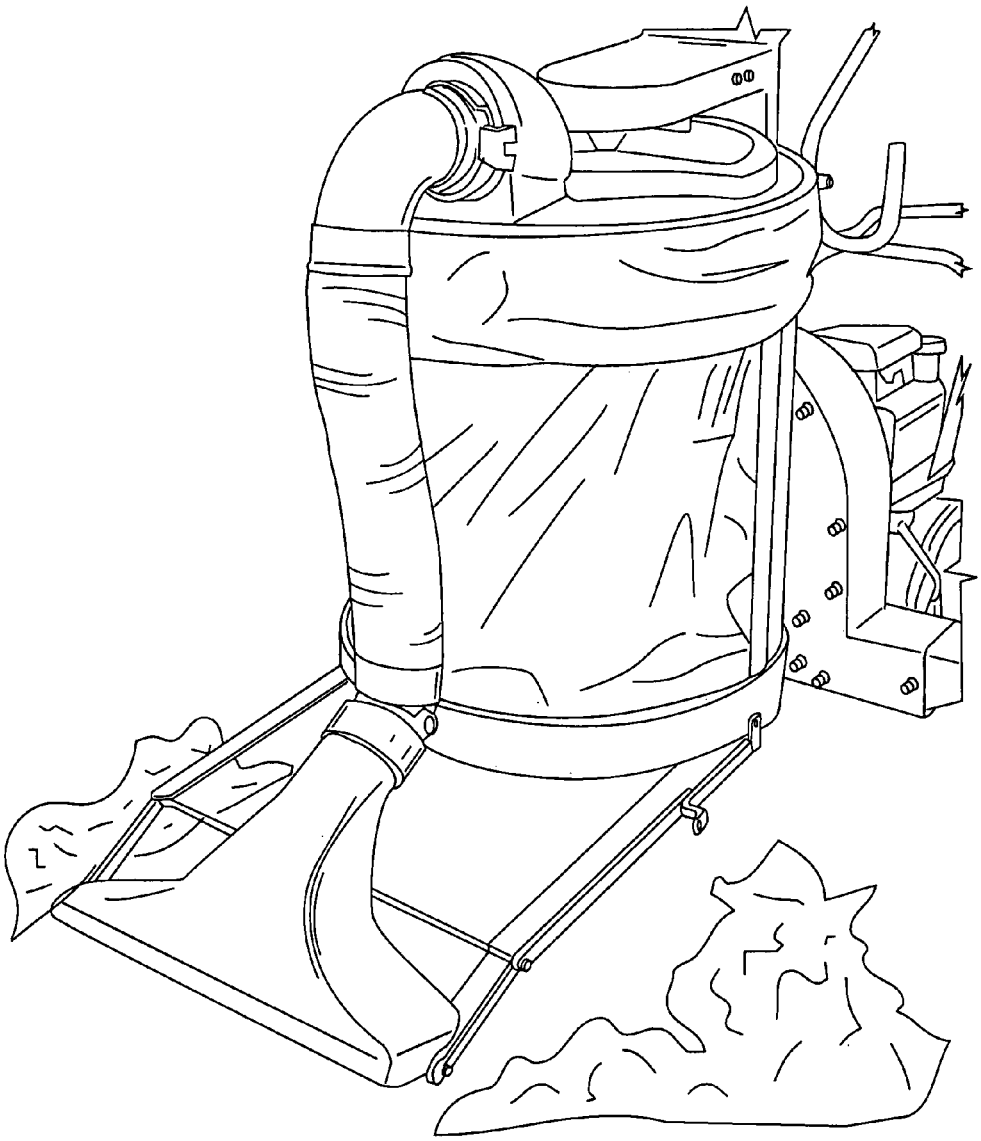
FIG. 15 is a perspective view illustrating one exemplary embodiment of a wide area cleaning tool used in conjunction with the gutter cleaning vacuum system of FIG. 1.

Referring to FIG. 9, the center portion 38 of the hinged vacuum manifold assembly 16 includes a telescoping mechanism 44 for selectively adjusting the effective length of the center portion 38 of the hinged vacuum manifold assembly 16, and thereby the effective height of the hinged vacuum manifold assembly 16, in order to accommodate a variety of collection drums 14.

A central concept of the present invention is that the novel hinged vacuum manifold assembly 16 (FIGS. 1-3 and 6) allows the blower/vacuum unit 12 (FIG. 1) to be disposed adjacent or next to the collection drum 14 (FIGS. 1-3). Advantageously, this allows the entire assembly to be placed on or attached to a mobile support structure 18 (FIG. 1), the back of a vehicle, a backpack harness, or the like. Such flexibility is important, especially related to gutter cleaning and other heavy-duty, outdoor applications.

FIGS. 10-15 illustrate various gutter cleaning tools that may be used in conjunction with the gutter cleaning vacuum system 10 (FIG. 1) of the present invention. In general, these tools comprise long sections of pipe, a curved end portion, various cleaning tips, a fully-articulated snake device, various handles, and the like through which air may flow. Using the tools (and other similar tools), an operator may vacuum or blow leaves, pinecones, mulch, and the like from gutters at potentially great heights (up to or exceeding 30 feet (approximately 9 meters)) from the safety and security of the ground, without the use of a ladder or the like. Preferably, the tools are formed from a lightweight clear plastic, such that blockages may be quickly and easily located and removed in the event that they occur. The tools have, in the case of extensions and the like, a diameter of between about 2 inches (approximately 51 mm) and about 4 inches (approximately 102 mm), although between about 2.5 inches (approximately 63.5 mm) and about 3 inches (approximately 76 mm) is most preferred, based on operational and ergonomic considerations.

Figure 16:
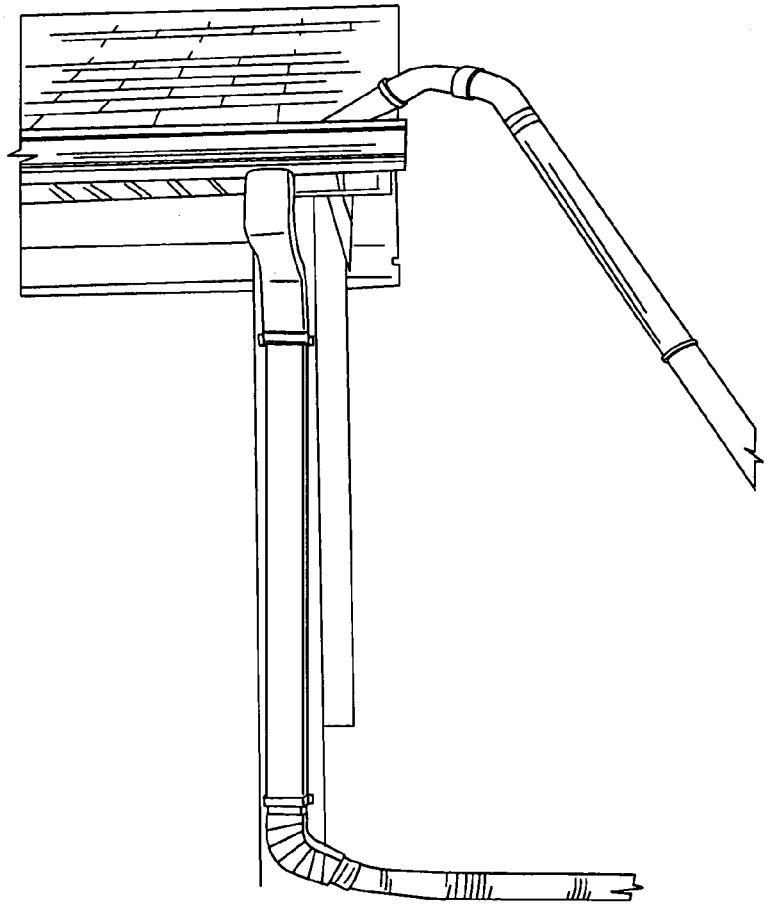
FIG. 16 is a partial perspective view illustrating a method for unclogging a down spout or the like using the gutter cleaning vacuum system of FIG. 1.
Figure 17:
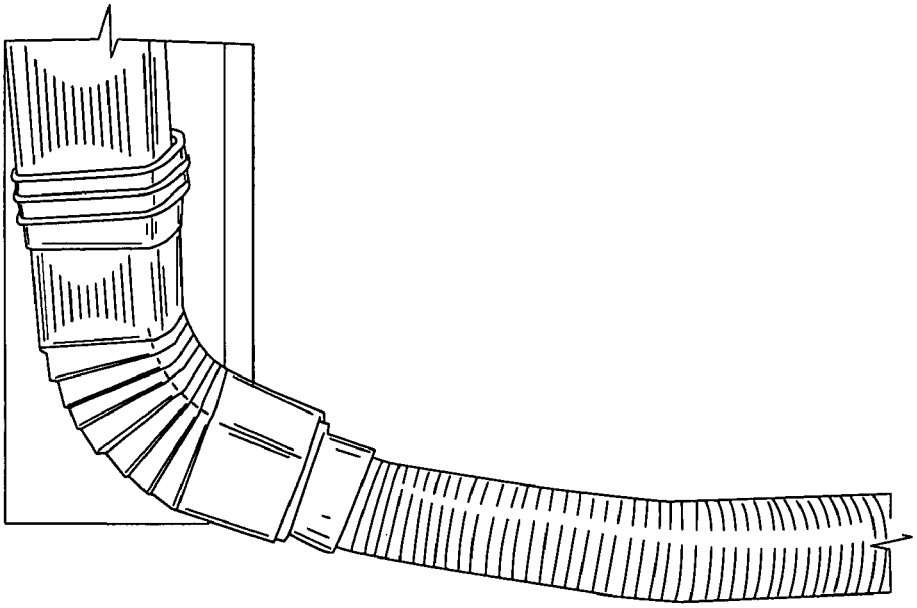
FIG. 17 is another partial perspective view illustrating the method of FIG. 16.
Figure 18:
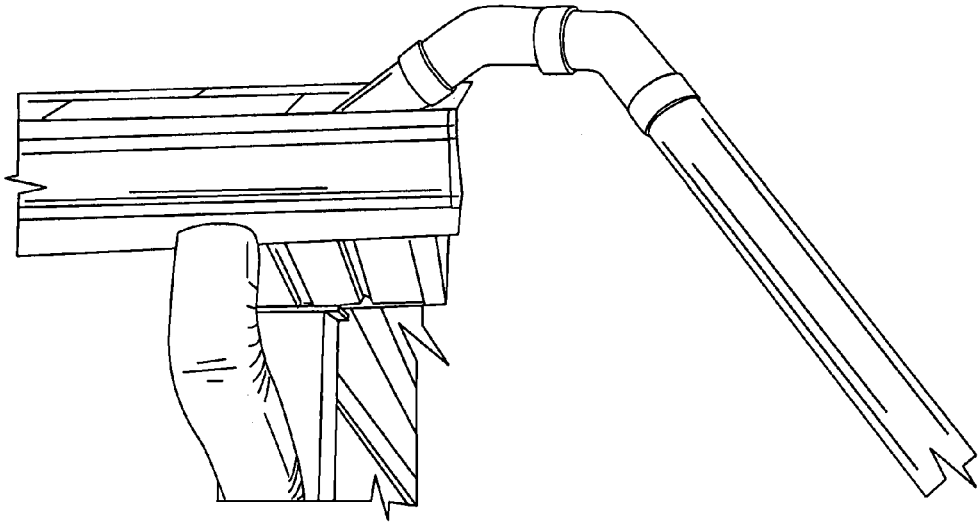
FIG. 18 is a further partial perspective view illustrating the method of FIG. 16.

Referring to FIGS. 16-18, one novel gutter cleaning method made possible by the gutter cleaning vacuum system 10 (FIG. 1) of the present invention involves attaching one end of a flexible hose or the like to a down spout that needs to be cleaned (because it is clogged, etc.) and attaching the other end of the flexible hose or the like to the exhaust of the blower/vacuum unit 12 (FIG. 1). This creates positive upwards pressure in the downspout, aiding in its vacuuming from the top in the conventional manner. Leaves, pinecones, mulch, and the like are literally blown out of the down spout into the air (or vacuum).

Figure 19:
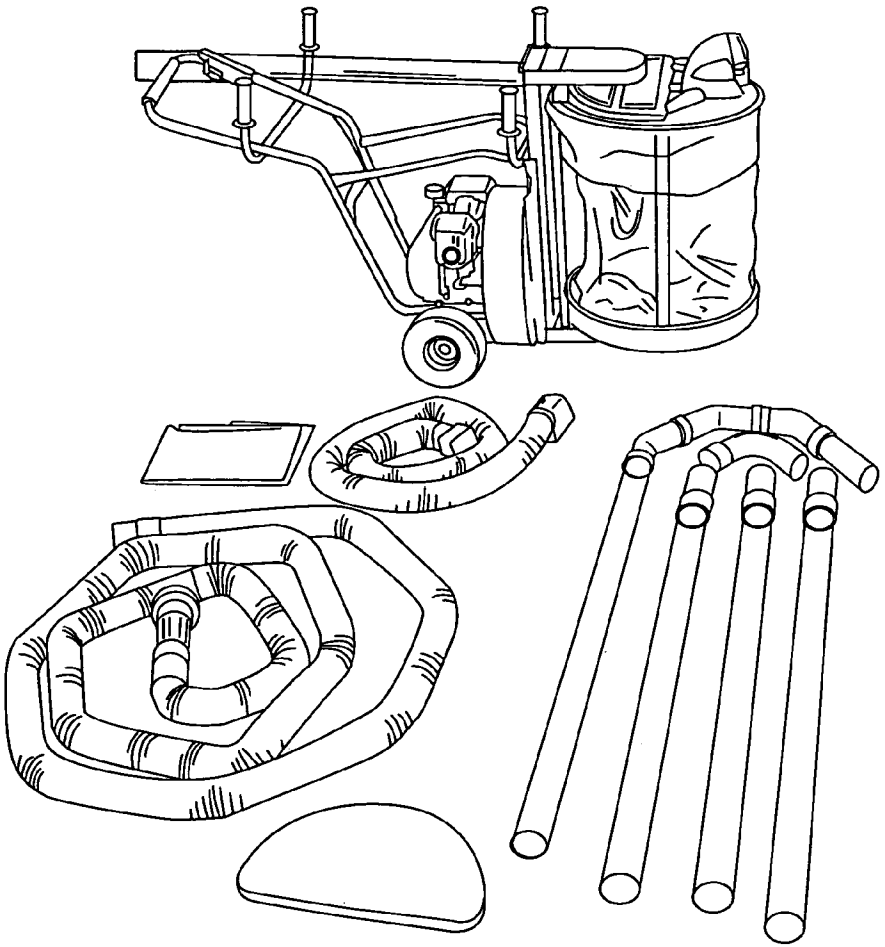
FIG. 19 is a perspective view illustrating the complete gutter cleaning vacuum system package, as might be sold to a consumer.

FIG. 19 illustrates the complete gutter cleaning vacuum system package, as might be sold to a consumer.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of, and are contemplated by, the present invention and are intended to be covered by the following claims.

What is claimed is:

1. A high volume vacuum collection apparatus, comprising:

a blower/vacuum unit, operable for generating a partial vacuum and blowing/suctioning flowing air;

a collection drum comprising a container having a base portion supporting the container, a top portion, and a removable lid with at least a first inlet and a second inlet, wherein the first inlet serves as an exit for the flowing air and the second inlet serves as an entrance for the flowing air and debris suctioned into the collection drum;

a manifold assembly that is in fluid communication with the blower/vacuum unit and the collection drum, thereby distributing the partial vacuum and the flowing air, wherein the manifold assembly has a top portion and a center portion at an offset angle to the top portion, wherein the top portion has a top port that fluidly and fixedly or removably engages the first inlet of the removable lid, and wherein the top portion is in fluid communication with the center portion; and wherein, in operation in a suction mode, as the flowing air and debris are suctioned into the collection drum, the debris falls out, collected by the container of the collection drum, and the flowing air exits through the manifold assembly.

2. The apparatus according to claim 1, wherein at least a portion of the collection drum is sufficiently transparent such that a level of collected debris can be visually determined with the removable lid on the collection drum, and while the apparatus is being operated.

3. The apparatus according to claim 1, wherein the manifold assembly has fluid communication through all portions, the suction emanating at an exhaust port that is in fluid communication with an air intake side of the blower/vacuum unit.

4. The apparatus according to claim 3, wherein the manifold assembly further comprises a bottom portion at an offset angle to the center portion, wherein the bottom portion of the manifold assembly further comprises a bottom port that is fluidly and fixedly or removably in communication with a third inlet, wherein the third inlet is on the collection drum.

5. The apparatus according to claim 4, wherein, operationally, the partial vacuum and air flow in the manifold assembly are distributed throughout the manifold, and the partial vacuum on the outside of a liner disposed within the container will have a lower pressure than a pressure on the inside of the liner, thereby maintaining the liner adhered to an interior surface of the container.

6. The apparatus according to claim 1, wherein the second inlet has an inlet adapter with an intake for large intake capacity and smaller diameter cleaning accessories.

7. The apparatus according to claim 6, wherein the inlet adapter has a multi-hose distribution head, such that several and various hoses, gutter cleaning, or other tools can be simultaneously attached.

8. The apparatus according to claim 1, wherein the removable lid further comprises an integral air filter.

9. The apparatus according to claim 8, wherein the removable lid has a dome shape to accommodate a larger air filter and to accommodate multiple second inlets that each have an inlet adapter with an intake for large intake capacity and smaller diameter cleaning accessories.

10. The apparatus according to claim 8, wherein the integral air filter is positioned between the manifold assembly connection and an interior of the container.

11. The apparatus according to claim 8, wherein the integral air filter is removably attached to a bottom inner side of the removable lid with a fastening means, such as a hook-and-loop type fastener with complimentary mated fastener strips.

12. The apparatus according to claim 1, wherein the removable lid has foam or rubber stripping along the interior of the rim for securing the removable lid to the container, wherein the stripping provides an air seal between the removable lid and the container.

13. The apparatus according to claim 1, wherein the manifold assembly comprises one or more of a hinged top portion, a telescoping top portion, a telescoping center portion, a hinged bottom portion, and a telescoping bottom portion.

14. A high volume vacuum collection apparatus, comprising:

a blower/vacuum unit, operable for generating a partial vacuum and blowing/suctioning flowing air;

a collection drum comprising a container having a base portion supporting the container, a top portion, and a removable lid with a first inlet and a second inlet, wherein the first inlet serves as an exit for the flowing air and the second inlet serves as an entrance for flowing air and debris blown suctioned into the collection drum;

a hinged manifold assembly that is in fluid communication with the blower/vacuum unit and the collection drum, thereby distributing the partial vacuum and the flowing air; wherein the manifold assembly has a top portion, a center portion, and a bottom portion, wherein the top portion has a top port that fluidly and fixedly or removably engages the first inlet of the removable lid, and wherein the top portion is in hinged fluid communication with the center portion through a top hinge mechanism that allows the top portion to be rotated upward with respect to the center portion; and wherein, in operation in a suction mode, as the suctioned flowing air and debris are suctioned into the collection drum, the debris falls out, collected by the container of the collection drum, and the flowing air exits through the hinged manifold assembly.

15. The apparatus according to claim 14, wherein the center portion of the hinged vacuum manifold assembly comprises a telescoping mechanism for selectively adjusting the effective length of the center portion of the hinged vacuum manifold assembly, which accommodates a variety of collection drums.

16. The apparatus according to claim 14, wherein the base portion supports the bottom of the container.

17. The apparatus according to claim 14, wherein the base portion is sufficiently reinforcing such that that the apparatus is fully portable, either hand carried, or carted by hand, or carried by a self-powered cart.

18. The apparatus according to claim 14, wherein the apparatus is carried on a vehicle, trailer, or the like, such as a gas or electric utility light-weight cart/ATV which is operationally suitable for movement over the ground.

19. The apparatus according to claim 14, wherein the hinged vacuum manifold assembly has a swivel connection, permitting hose connections to the second inlet to be used approximately 340 degrees around the axis of the swivel connection.

20. The apparatus according to claim 19, wherein the swivel connection employs a push through gasket.

21. The apparatus according to claim 14, wherein the hinged manifold assembly comprises two rectangular ducts each having an interior cross-sectional area comparable to the three manifold assembly portions, where the two rectangular ducts are hingedly coupled through a modified pipe joint, thereby permitting the movement of air and the hinged rotation of the ducts.

22. The apparatus according to claim 14, wherein the suctioned flowing air provided by the blower/vacuum unit is greater than 60 CFM (approximately 1700 liters/minute), and typically greater than 200 CFM (approximately 5663 liters/minute).

* * * * *